US008347421B2

(12) United States Patent
Krueger

(10) Patent No.: US 8,347,421 B2
(45) **Date of Patent: *Jan. 8, 2013**

(54) IMPACT REDUCTION SYSTEM

(75) Inventor: Wesley W. O. Krueger, San Antonio, TX (US)

(73) Assignee: Body Armour Technology, LLC, San Antonio, TX (US)

( * ) Notice: Subject to any disclaimer, the term of this patent is extended or adjusted under 35 U.S.C. 154(b) by 245 days.

This patent is subject to a terminal disclaimer.

(21) Appl. No.: 12/728,073

(22) Filed: Mar. 19, 2010

(65) Prior Publication Data

US 2010/0186154 A1 Jul. 29, 2010

Related U.S. Application Data

(63) Continuation-in-part of application No. 11/828,326, filed on Jul. 25, 2007, now Pat. No. 7,917,972.

(51) Int. Cl.
*A41D 13/00* (2006.01)

(52) U.S. Cl. ..... 2/459

(58) Field of Classification Search ..... 2/16, 455, 2/94, 267, 412, 69, 108, DIG. 3, 459
See application file for complete search history.

(56) References Cited

U.S. PATENT DOCUMENTS

| | | | |
|---|---|---|---|
| 1,587,946 | A | 6/1926 | Gibson |
| 1,774,060 | A | 8/1930 | Hodge |
| 2,438,142 | A | 3/1948 | Brower |
| 3,257,666 | A | 6/1966 | Hoffman |
| 3,872,511 | A | 3/1975 | Nichols |
| 4,353,133 | A | 10/1982 | Williams |
| 4,375,108 | A | 3/1983 | Gooding |
| 4,493,115 | A | 1/1985 | Maier et al. |
| 4,922,641 | A | 5/1990 | Johnson |
| 5,095,545 | A | 3/1992 | Lane |
| 5,265,366 | A | 11/1993 | Thompson |
| 5,375,360 | A | 12/1994 | Vatterott |
| 5,461,813 | A | 10/1995 | Mazzola |
| 6,029,962 | A | 2/2000 | Shorten |
| 6,257,562 | B1 | 7/2001 | Takashima et al. |
| 6,453,477 | B1 | 9/2002 | Bainbridge et al. |
| 6,588,023 | B1 | 7/2003 | Wright |
| 6,684,547 | B2 | 2/2004 | Poff, Jr. |
| 6,758,466 | B2 | 7/2004 | Russell |
| 6,834,456 | B2 | 12/2004 | Murello |
| 6,976,333 | B2 | 12/2005 | Sims |
| 7,055,277 | B2 | 6/2006 | Sims |
| 7,082,621 | B1 | 8/2006 | Fratesi |

(Continued)

OTHER PUBLICATIONS

Chiara Daraio, Vitali F. Nesterenko, and Sungho Jin. "Impact response by a foamlike forest of coiled carbon nanotubes": Journal of Applied Physics 100, (2006) 064309-1-06309-4 (American Institute of Physics). Downloaded Apr. 16, 2007 to 130.127.189.238. Redistribution subject to AIP license or copyright, see http://jap.aip.org/jap/copyright.jsp.

*Primary Examiner* — Tejash Patel
(74) *Attorney, Agent, or Firm* — Douglas W. Rommelmann; Andrews Kurth LLP

(57) ABSTRACT

An impact reduction device including a pad having a first layer and a second layer. At least one of the first and second layers defines at least one impression. The impact reduction device is arranged and configured to at least partially collapse upon application of a force and to regain its shape after removal of the force.

9 Claims, 14 Drawing Sheets

U.S. PATENT DOCUMENTS

| | | | | |
|---|---|---|---|---|
| 7,152,356 | B2 | 12/2006 | Sims | |
| 7,168,104 | B2 | 1/2007 | Tobergte | |
| 7,232,118 | B2 | 6/2007 | Maeno et al. | |
| 7,376,978 | B2 | 5/2008 | Godshaw | |
| 7,774,866 | B2 | 8/2010 | Ferrara | |
| 7,917,972 | B1 * | 4/2011 | Krueger | 2/459 |
| 2006/0254112 | A1 | 11/2006 | Snoderly | |

* cited by examiner

IMPACT REDUCTION SYSTEM

CROSS-REFERENCE TO RELATED APPLICATIONS

This application is a continuation-in-part application of U.S. application Ser. No. 11/828,326, filed Jul. 25, 2007 now U.S. Pat. No. 7,917,972, which is hereby incorporated by reference in its entirety.

FIELD OF THE INVENTION

The present invention generally relates to devices for absorbing shock. More particularly, the present invention relates to impact reduction devices for use in contact sports, gravity game sports, marksmanship, or other potential contact activities.

BACKGROUND OF THE INVENTION

Protective pads are used in a variety of applications to protect the body from injury-causing physical impact. For example, athletes often wear protective pads while playing sports, such as American football, hockey, soccer, gravity game sports, and baseball, among others. In addition, many marksmen wear protective pads while shooting firearms to increase their accuracy and protect their bodies from forces associated with firearm recoil.

In the case of marksmanship, not only will the recoil of a gun cause potential injury, but it may also affect the accuracy of the marksman. For example, if the marksman anticipates a recoil, he may flinch upon firing the gun. This flinching may disturb the alignment of the gun as it is fired leading to missed shots and inaccuracies. Use of a device to absorb the shock of the recoil may help to avoid flinching because the impact of the recoil against the marksman's body be softened.

In the athletic industry, many pads are constructed of high density molded plastic material combined with open or closed cell foam padding. This padding is stiff and absorbs the energy of an impact force, dissipating that energy over an expanded area. Thus any one point of the body is spared the full force of the impact, thereby reducing the chance of injury.

Another type of pad often used in the athletic industry utilizes a honeycomb structure designed to be rigid in the direction of the impact, but flexible in a direction perpendicular to the impact. Upon application of an impact force, the honeycomb structure is deformed or crumpled in order to absorb as much of the potentially damaging impact as possible. In this way, less of the total kinetic energy of the impact is transferred to the body, while the impact reduction remains in the plane of the impact.

Similarly, in the firearm industry, a marksman may use a recoil buffer or arrestor to cushion the impact of a firearm as it recoils. Many recoil buffers are pads formed of a resilient material, such as leather, gel, foam, or rubber. Pads may be worn on the marksman's body or they may be formed as an integral part of a firearm, such as a rubber butt pad on a shotgun. The purpose of recoil buffers is similar to that of the athletic pads discussed above. That is, to absorb and disperse the energy of a recoil impact to protect the body of the marksman.

There are shortcomings with pads currently available for use in athletic and marksmanship applications. For example, athletes must often be quick and have freedom of movement. Existing athletic padding is generally heavy and bulky. In the case of padding having a honeycomb structure, the padding is rigid. Thus, use of existing pads decreases the ability of an athlete to move quickly and limits the athlete's freedom of movement. Many football players, for example, avoid the use of hip or thigh pads because of their weight, bulkiness, and the limiting effect that such pads have on mobility.

In the case of firearms, existing recoil buffers too often fail to disperse the kinetic energy of a recoil in a broad way. The result is that the full impact force of the recoil is concentrated in a localized area, resulting in flinching and possible injury.

Therefore, it is desirable to provide an impact reduction pad that overcomes the disadvantages of the prior art.

SUMMARY OF THE INVENTION

One aspect of the present invention provides pads of increased flexibility and decreased weight by constructing the pads of two thin layers of low density polyethylene material, where at least one layer has a series of dimples or impressions formed therein. The first layer of polyethylene may be configured to be positioned proximate to a human body. This first layer may define dimples or protrusions extending outwardly away from the body. The second layer may be configured to be positioned over the top of the first layer in a position removed from the body. This second layer may be constructed of low density polyethylene material formed into a flat sheet with no dimples. Alternatively, the second layer may define dimples that extend toward and come in close proximity to the dimples of the first layer. The second layer may be positioned opposite the first layer with the dimples of the first layer protruding in a direction toward the second layer or with dimples on each layer coming into close contact with each other.

Upon application of an impact force, the layers of the pads disperse the kinetic energy of the impact in at least two ways. First, the low density polyethylene material that makes up the first and second layers dissipates the energy in a broad way, including outside the plane in which the force is applied. Second, the dimples formed in the first layer will compress and collapse against either the flat second layer or a corresponding dimple of the second layer. As the dimples collapse, the kinetic energy that is directed parallel to the center axis of each dimple will be diffused. The majority of the energy will be redirected 360 degrees radially from the apex of the dimples and along the arcs thereof. Moreover, upon collapse of the dimples, some energy will also dissipate in the form of elastic energy, heat, sound, and so forth. Thus, the amount of kinetic energy from the impact that passes through the pad and into the human body is greatly reduced and more broadly dispersed.

Another aspect of the present invention provides an inflatable bladder configured to be positioned between the first and second layers of the pads. The bladder includes a valve for attachment to a pump or air inflation system. Inflation of the bladder, using the pump, adds a further cushion of air to the device. The air may serve to further dissipate the energy of an impact force beyond that level achieved by the polyethylene layers alone. In addition, additional mechanisms, such as carbon nanotubes, may be added to the pads in order to further dissipate energy.

Because the dimples of the layers of the present pads dissipate at least a portion of the impact energy, the thickness of the pads can be greatly reduced compared to pads of the prior art. The reduction of thickness of the pads may be further accomplished by including dimples on only one layer of the pads, as shown in FIG. 12, or by staggering the dimples of the two layers so that they are offset, with the apices of the dimples of the first layer corresponding to the voids between the dimples of the second layer, as shown in FIG. 13. The corresponding reduction of thickness of the present pads allows the pads to be lighter weight, less bulky, more flexible, and permit ore freedom of movement than pads of the prior art. Furthermore, the inflatable bladder of the present pads may provide increased protection and allow the user to adjust the level of impact resistance of the pad according to the requirements of the particular user and circumstance.

One embodiment of the present invention relates to an impact reduction device including a pad having a first layer and a second layer, wherein at least one of the first and second layers defines at least one impression arranged and configured to at least partially collapse upon application of a force. The device may include nanotubes attached to at least a portion of the pad and configured to increase the impact resistance thereof. Preferably, the nanotubes may be selected form the group consisting of coiled nanotubes and composite carbon nanotubes. Further preferably, the device may include a bladder disposed between the first and second layers of the pad and configured to be inflated or deflated by a detachable pump.

In a preferred embodiment, the first and second layers of the pad may be composed of low density polyethylene material and the shape of the pad may be configured to conform to a predetermined portion of a user's body. Preferably, the device may include a puncture preventing layer on the surface of the bladder and the bladder may have a valve. The valve may be configured to facilitate inflation of the bladder by a detachable pump or other air inflation system and may be configured to be disposed at the edge of the pad when the air bladder is disposed between the first and second layers of the pad. Further preferably, the detachable pump may be selected from the group consisting of hollow bulbs for manual compression, an aerosol pump, or a pneumatic pump.

In one preferred embodiment of the device, the first layer may define at least one impression and the second layer may be a flat layer. Furthermore, the first layer may be composed of a low density polyethylene material and the flat layer may be composed of a low density polyethylene material.

Preferably, the first layer may define a plurality of impressions having void spaces therebetween, and the second layer may define a plurality of impressions arranged so that when the first and second layers are joined the impressions of the second layer align with the void spaces between the impressions of the first layer. Further preferably, the first layer may be configured to be positioned proximate a user's body and the flat layer may be configured to be positioned remote from the user's body.

An alternative embodiment of the present invention relates to an impact reduction pad for protecting a human body from impact including a resilient portion and an inflatable portion in contact with the resilient portion. The resilient portion may include dimples arranged and designed to collapse upon application of a force to the pad.

Preferably, the resilient portion may have a first side and a second side wherein the first side is free of dimples. Alternatively, the resilient portion may have a first side and a second side, wherein both the first and second sides have dimples and the dimples are arranged with void spaces therebetween. The dimples of the first layer may align with the void spaces between the dimples of the second layer when the first and second layers are joined. In addition, the pad may be shaped to conform to a predetermined part of a human body. Further preferably, the predetermined part of a human body may be selected from the group consisting of the head, neck, shoulder, ribs, spine, hip, thigh, lower leg, upper arm, forearm, wrist, and ankle.

In a preferred embodiment, the impact reduction pad may further include nanotubes attached to at least a portion of the pad to increase the impact resistance thereof. The nanotubes may be selected from the group consisting of coiled nanotubes and composite nanotubes. In addition, the pad may include a puncture resistant layer contacting the inflatable portion of the pad to prevent puncture thereof. The puncture resistant layer may be composed of nanotubes. Preferably, the pad may also include a pump configured for releasable attachment to the inflatable portion of the pad to facilitate inflation or deflation thereof.

BRIEF DESCRIPTION OF THE DRAWINGS

The present invention will be better understood on reading the following detailed description of nonlimiting embodiments thereof, and on examining the accompanying drawings, in which.

DETAILED DESCRIPTION

Figure 1:
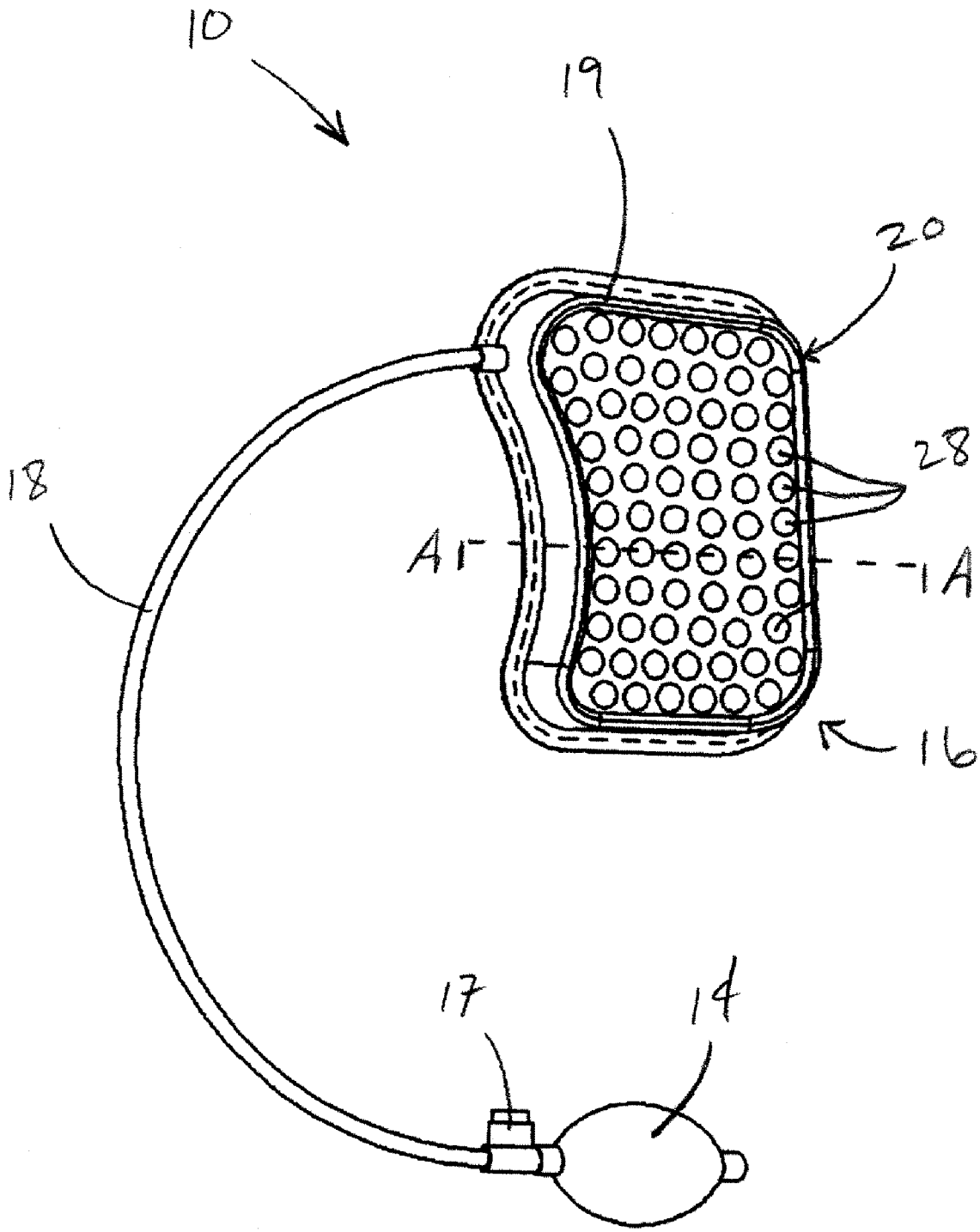
FIG. 1 is a front, perspective view of an embodiment of the present invention.

The foregoing aspects, features, and advantages of the present invention will be further appreciated when considered with reference to the following description of preferred embodiments and accompanying drawings, wherein like reference numerals represent like elements. In describing the preferred embodiments of the invention illustrated in the appended drawings, specific terminology will be used for the sake of clarity. However, the invention is not intended to be limited to the specific terms used, and it is to be understood that each specific term includes equivalents that operate in a similar manner to accomplish a similar purpose.

Figure 2:
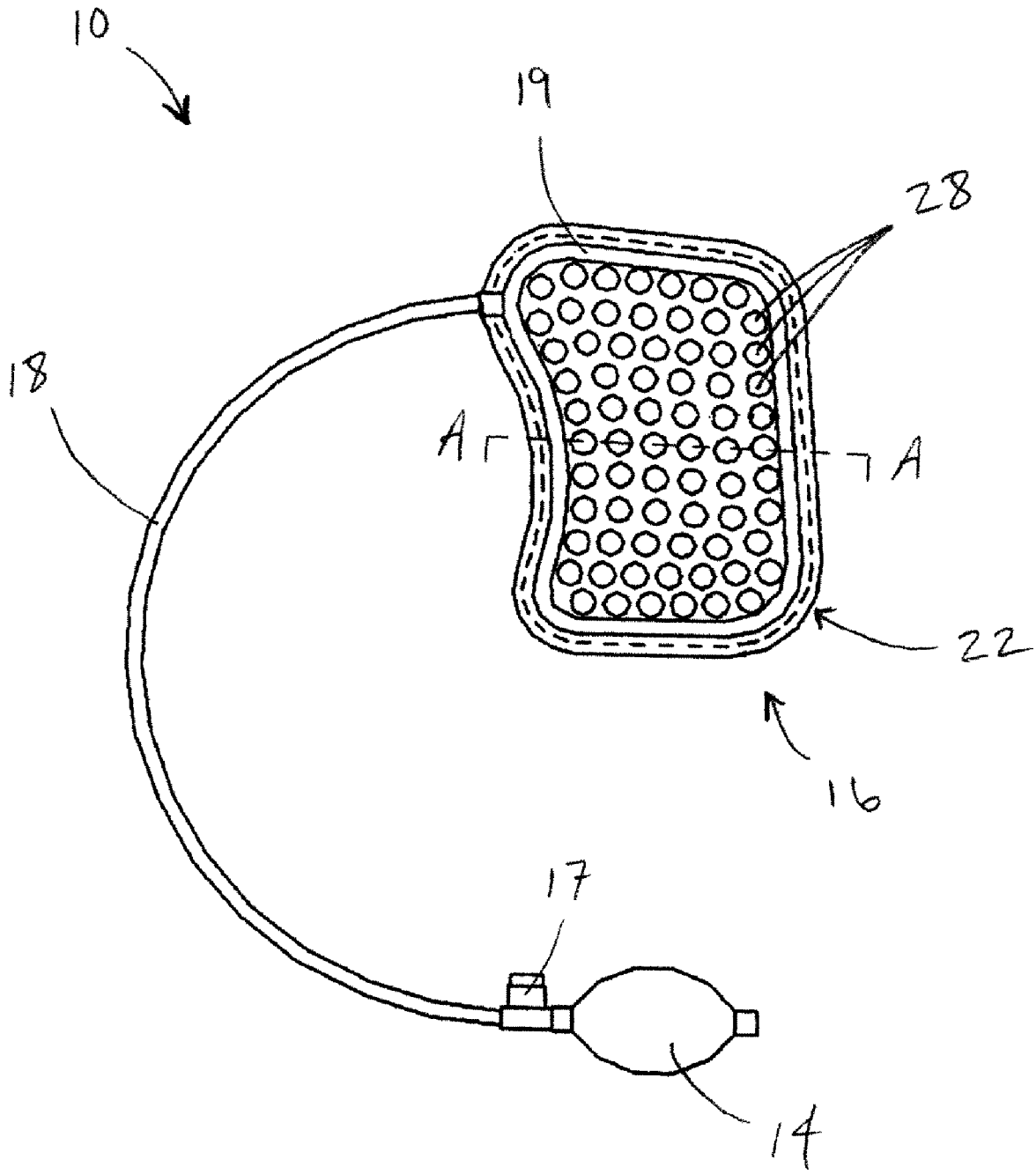
FIG. 2 is a back, perspective view of the embodiment of FIG. 1.

Referring now to the drawings, FIGS. 1 and 2 show an impact reduction device 10 in accordance with an embodiment of the present technology. The impact reduction device 10 may include a pad 16 formed of two opposing layers, including a back layer 22 and front layer 20. The pad 16 may include one or more ribs 19 to stiffen the pad at its periphery and define the shape of the pad. Furthermore, each layer 20, 22 of the pad may define dimples 28 protruding in a direction toward the opposing layer. The impact reduction device 10 may optionally include a bladder 24 (shown in FIG. 3) disposed between the first and second layers of pad 16. In addition, impact reduction device 10 may include a pump 14 connected to the bladder 24. Pump 14 may inflate or deflate the bladder 24 by way of a conduit 18 connecting the pump 14 to the bladder 24.

Figure 3:
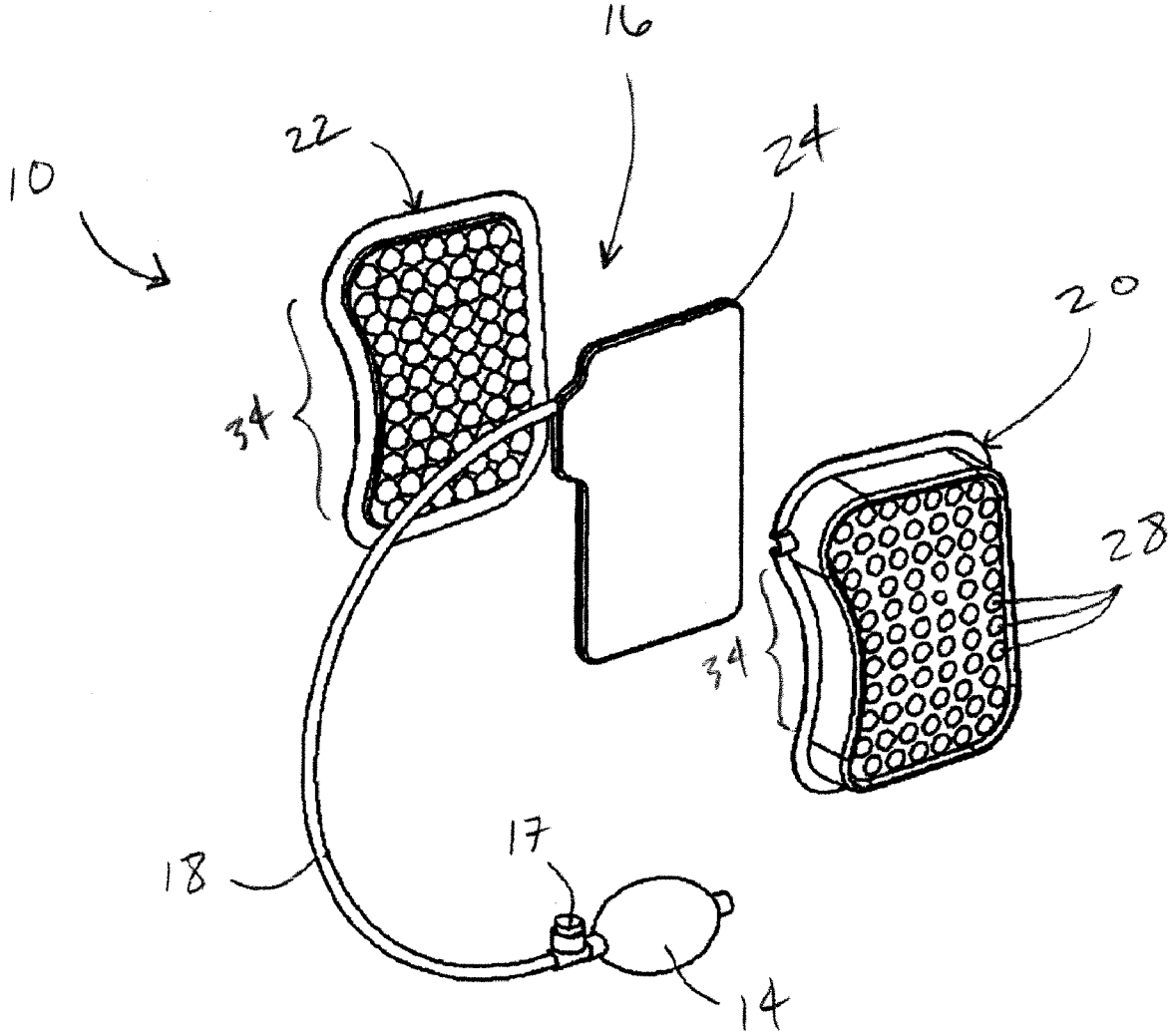
FIG. 3 is an exploded perspective view of the embodiment of FIGS. 1-2.
Figure 7:
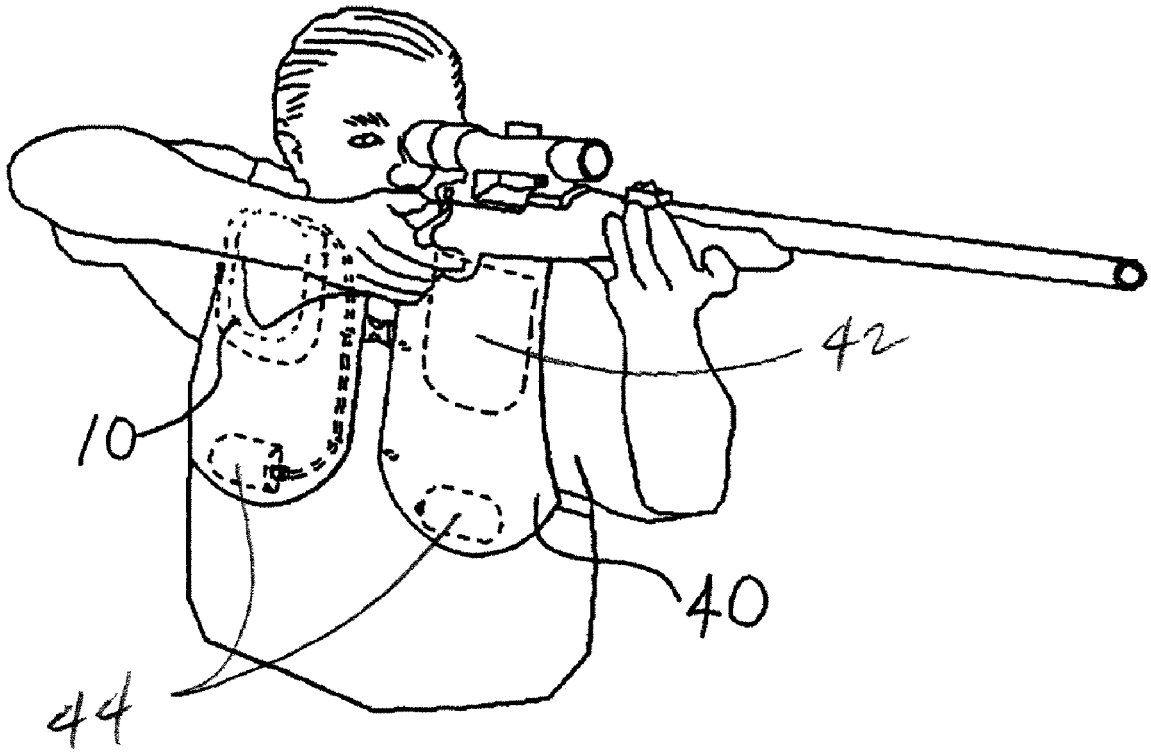
FIG. 7 shows the vest of FIG. 6 in use.
Figure 8:
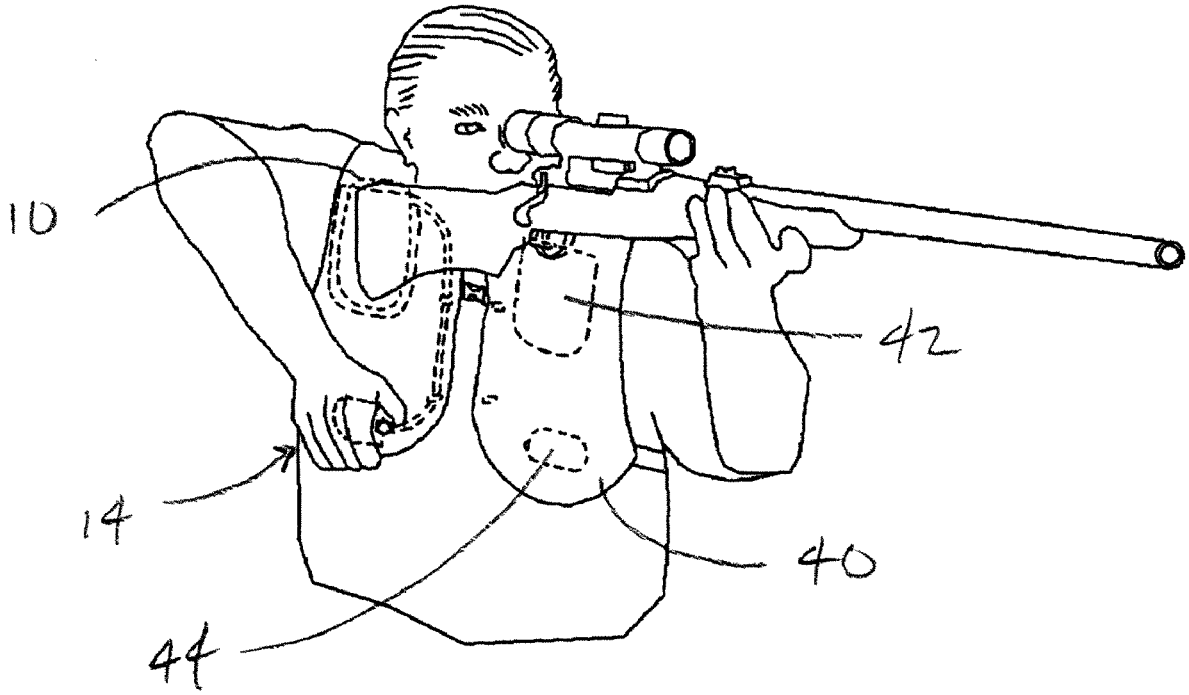
FIG. 8 shows the vest of FIG. 6, with the user adjusting the recoil suppression system by inflating the bladder connected to a manual pump.

The shape of the pad 16 will be predetermined by the intended placement of the pad on the human body. For example, in the case of a pad to protect against recoil of a rifle, the pad may likely be placed over the shoulder of a user, as shown in FIGS. 7 and 8. Thus, the pad may be shaped as shown in FIG. 3, with a curved contour 34 positioned to allow a user to turn his head and neck freely without impedance by the pad 16. Alternatively, such as where the pad will be used as an athletic pad, the pad may be shaped to conform to, for example, the head (for use in a helmet), neck, shoulder, ribs, spine, hip, thigh, knee, lower leg, upper arm, forearm, wrist, ankle, hand, and so forth. The shape of the pad may be determined by the application and the portion of the body that the pad is intended to protect.

Again referring to FIG. 3, there is shown an exploded view of the shock absorbing device 10, including layers 20 and 22 of the pad. Layer 22 may preferably be substantially flat and configured for placement proximate a user's body. In contrast, layer 20 may preferably be recessed so as to define an interior volume. As can be clearly seen, when layer 20 is superimposed over layer 22, the interior volume of layer 20 may receive a bladder 24, discussed below, so that when the pad 16 is assembled the bladder 24 is disposed between layers 20 and 22.

Preferably, the layers 20 and 22 may be joined at their peripheries, thereby enclosing the above discussed void between the layers. Such an enjoinment of the layers at their peripheries may preferably be accomplished by mechanical, thermal, or chemical means. Alternatively, the multi-layered pad 16 may be formed by a molding or other process. The edges of the molds may preferably be heat sealed, so there is no shifting of the layers relative to each other after they are joined.

Further preferably, the layers 20 and 22 of pad 16 may be composed of low density polyethylene materials or nanotubes. This low density polyethylene material may have a thickness of between 0.01 to 0.04 inch. Polyethylene is a desirable material for use in the present technology because upon receiving an impact force, polyethylene has the ability to compress and break down in order to absorb shock and dissipate energy. Moreover, after the impact force passes, polyethylene then has the ability to return to its pre-impact state. This resilience, or memory, enables a pad made from polyethylene to be reused multiple times without losing its effectiveness as an impact reduction pad. Alternative materials, such as coiled carbon nanotubes or composite carbon nanotubes possessing similar impact reduction qualities may also be used.

Figure 4:
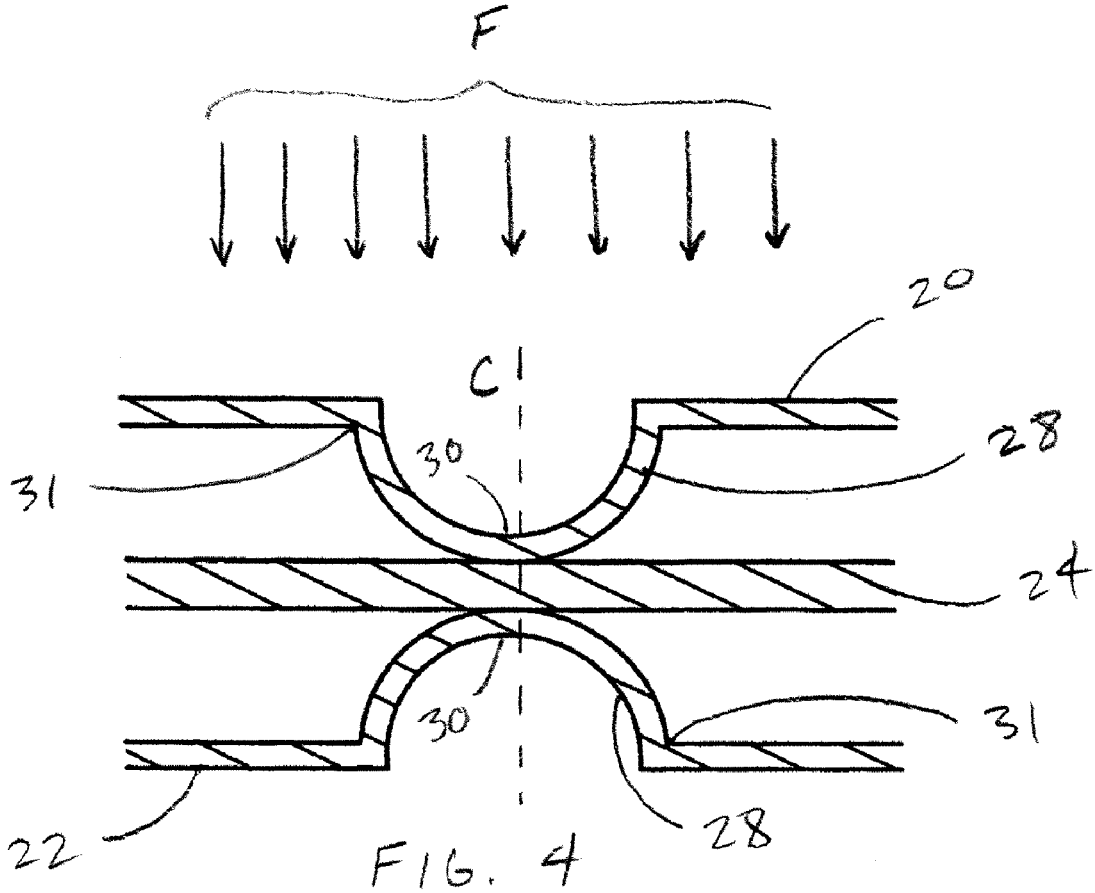
FIG. 4 is a cross sectional view of the embodiment of FIGS. 1-3 taken along line A-A of FIGS. 1 and 2.
Figure 5:
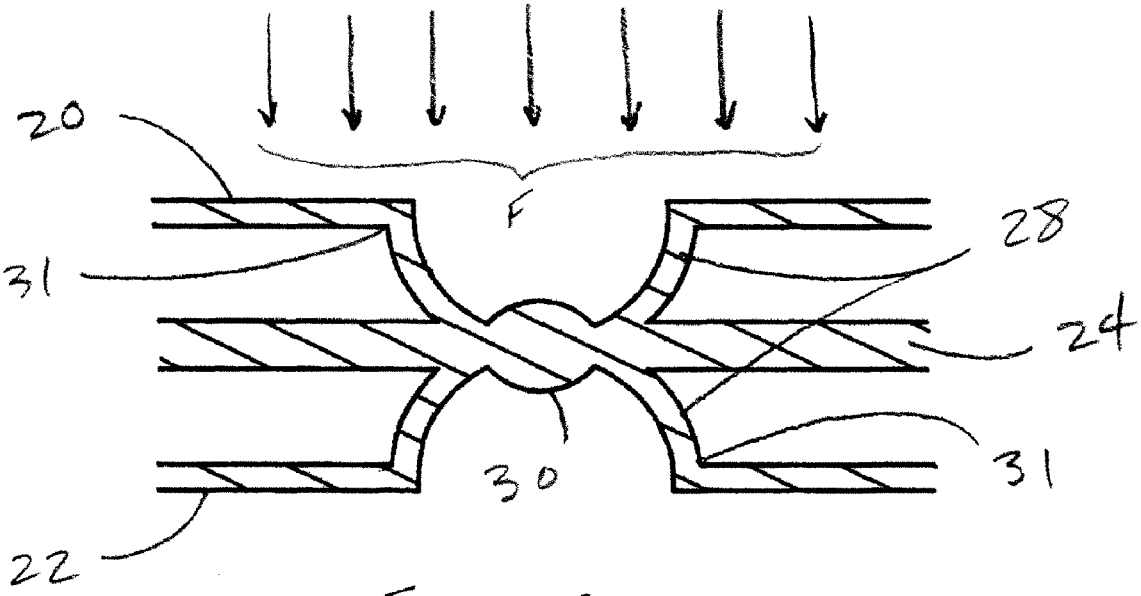
FIG. 5 is a cross sectional view of the embodiment of FIGS. 1-3 taken along line A-A of FIGS. 1 and 2 upon application of a force F to the pad.

FIGS. 4 and 5 show cross-sectional views of the dimples 28 of the pads of the present technology. FIG. 4 shows layers 20 and 22 in an assembled state with bladder 24 disposed therebetween. In the drawing, bladder 24 is shown in its deflated form. The dimples 28 of each layer may be configured to extend inwardly toward the opposing layer of the pad. The apices remain in alignment during use of the pad because the edges of the pads are joined using a heat seal, as discussed above. Each dimple 28 has an apex 30 and a base 31. As an impact force F is applied to the pad, the layers 20 and 22 of the pad are pressed together, thereby bringing the apices of opposing dimples 28 together. Force F is directed parallel to the center axis C of the dimples. As force is applied to the apex of each dimple 28, the energy exerted by force F is dissipated around the circumference to the base of each dimple. From the base, the energy is dispersed radially 360 degrees along the plane of the layer within which the dimple is formed. Thus, the energy of the impact force is directed away from the user's body along the plane defined by the surface of the pad, and the body is protected.

In addition to the above, the dimples 28 dissipate the energy of an associated impact force by collapsing. That is, at some point during application of impact force F, the magnitude of the force, and the amount of kinetic energy imposed upon the pad thereby, may be large enough to collapse or partially collapse the dimples as shown in FIG. 5. When this occurs, the energy entering the pad is further dissipated in the form of elastic energy, heat, sound, etc. Thus, the dimples 28 serve to dissipate energy and protect the user of the pad in more than one way. Furthermore, because the dimples 28 are formed of polyethylene, they are elastic and resilient, and will return to their normal shape after removal of the impact force.

As discussed above, and shown in FIG. 3, bladder 24 may be disposed between layers 20 and 22 of pad 16. The bladder 24 may preferably include walls enclosing a void, like a balloon, although it is not intended to be limited to this structure. For example, the bladder could alternatively be an inflatable foam or other material capable of retaining air or other fluid and whose volume is adjustable depending on the amount of air or other fluid retained. In use, bladder 24 may substantially fill the interior volume between back layer 22 and front layer 20. Bladder 24 may be inflated with a fluid, preferably air, to a desired level. The fluid-filled bladder may then provide additional cushion or protection against impact forces by absorbing impact energy before it reaches a user's body. When the inflated bladder 24 is used along with the dimpled layers of the pad, the energy dissipation abilities of each component work together to provide a high level of protection that could not be achieved by the use of any one component by itself.

Bladder 24 may be inflated or deflated by a detachable pump 14, shown in FIGS. 1-3. The pump 14 may be a manual pump as shown in the drawings. Alternatively, the pump 14 may be powered by an outside source such as, for example, an electrical, aerosol, or pneumatic source. In the embodiment shown in FIGS. 1-3, the pump 14 is connected to the bladder 24 via a conduit 18. Conduit 18 may be any suitable conduit for carrying air or other fluids. In addition, a valve 17 may be inserted between the pump 14 and bladder 24 to maintain the fluid pressure in the bladder, to provide an indication of the pressure contained in the system, or to allow the user to relieve pressure by releasing air.

One aspect of the present technology includes the method of using the pads 16 to protect the human body from potentially injury-causing impact. In the case of marksmanship, the pads 16 of the shock absorbing device 10 may preferably cover the front of the shoulder of a marksman as shown in FIGS. 7 and 8. If the marksman is firing a rifle, the pads 16 may be positioned such that the butt of the rifle contacts the pads. Thus, when the rifle is fired and recoils, the impact force from the butt of the rifle enters directly into the device 10 and the kinetic energy of the impact force is dissipated by the pads and the bladder of the device.

Figure 6:
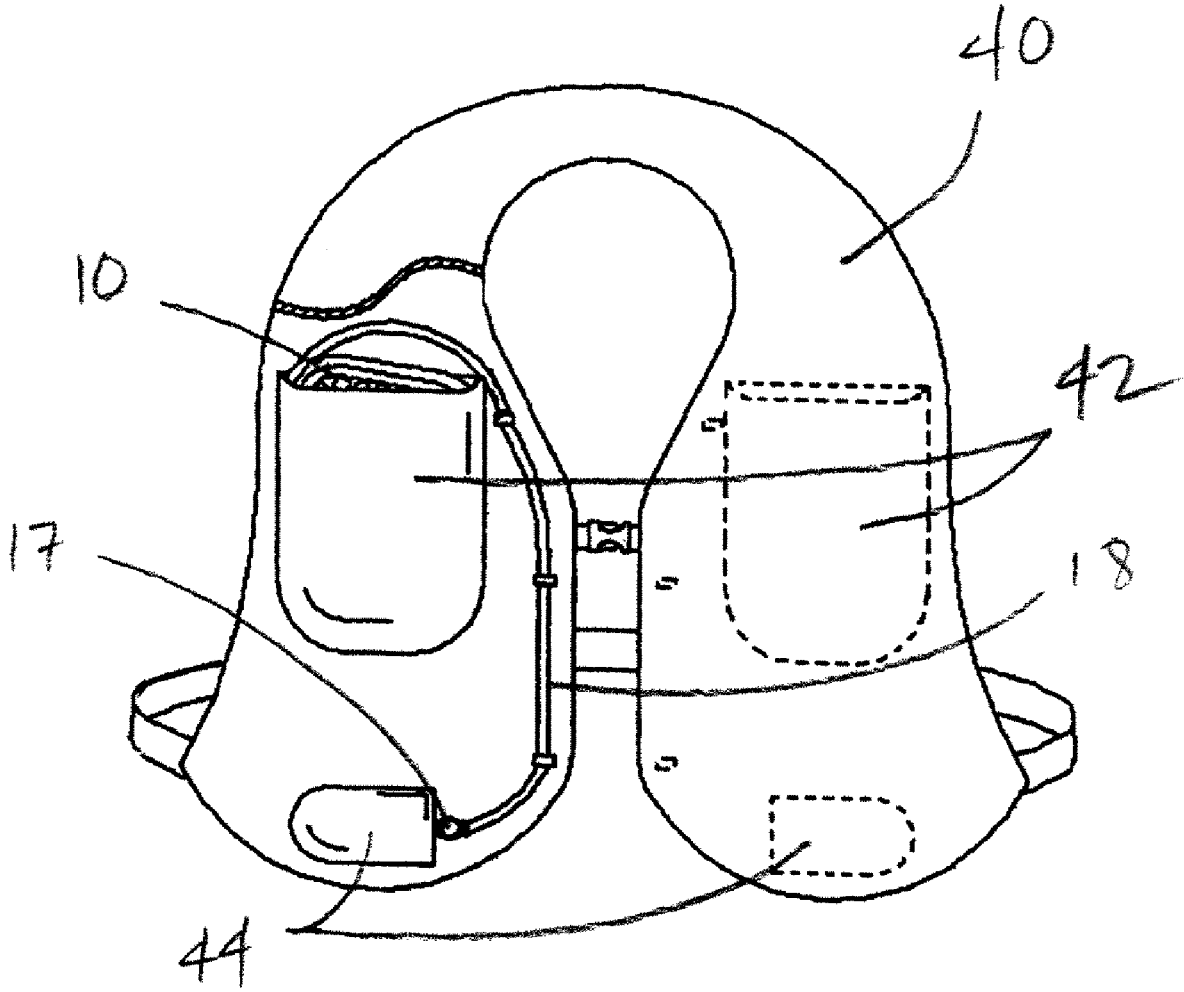
FIG. 6 is a front view of a shooting vest with an embodiment of the present invention incorporated therein for recoil suppression.

Referring to FIGS. 6-8, device 10 may be used with a vest 40 or other piece of clothing. The vest 40 may include pockets 42 and 44 for supporting the pads 16 and the pump 14 of the device 10 in a desired location. The pockets 42 and 44 may be positioned on the right or the left side of the vest 40 in order to accommodate users having differing dexterity. In addition, positioning the pump 14 of the device 10 in a lower pocket 44 of the vest 40, as shown in FIG. 8, is ergonomically conducive to adjusting the pressure in the bladder 24 by providing the user's hand easy access to the pump 14.

Figure 9:
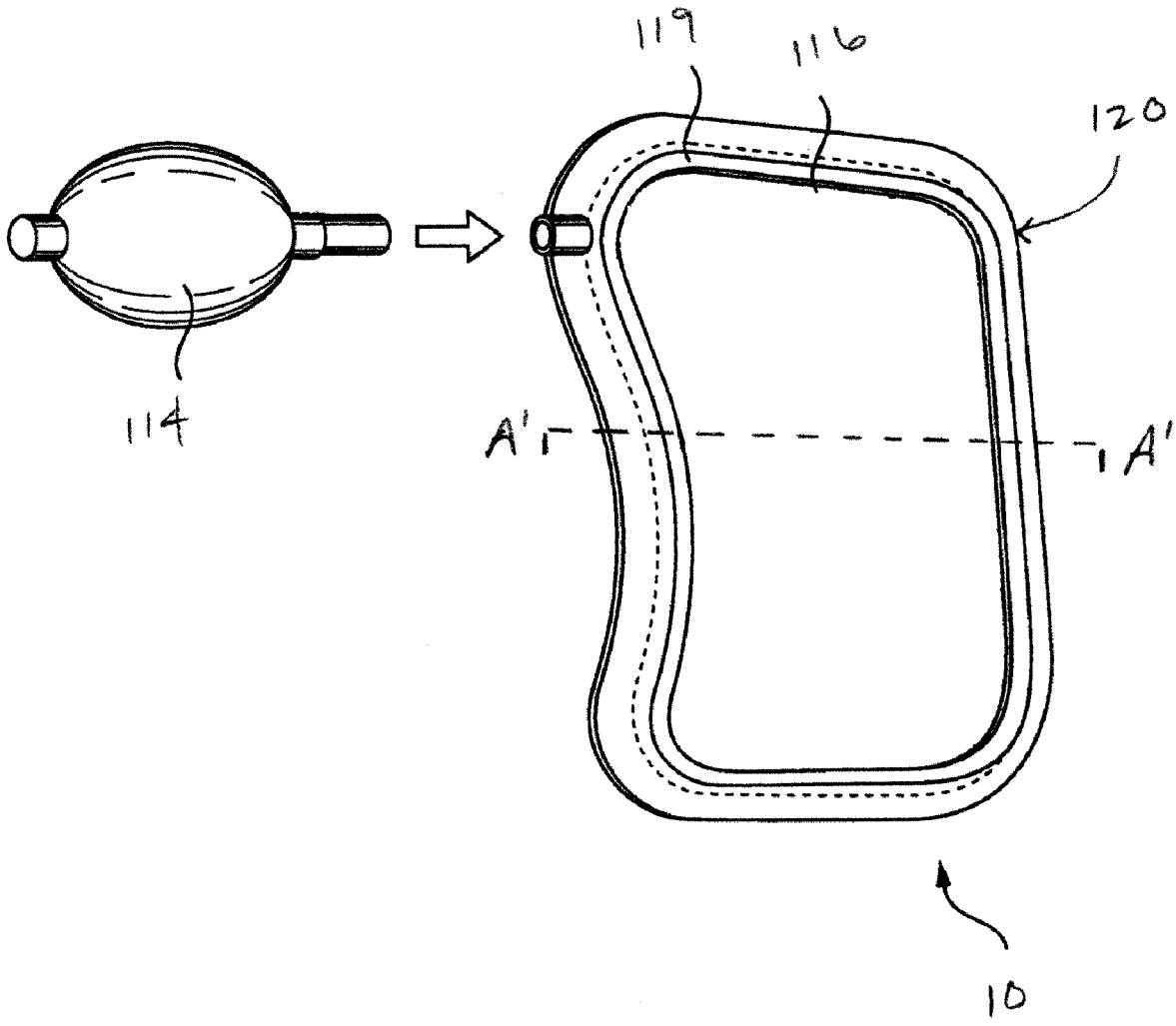
FIG. 9 is a front, perspective view of an alternative embodiment of the present invention.
Figure 10:
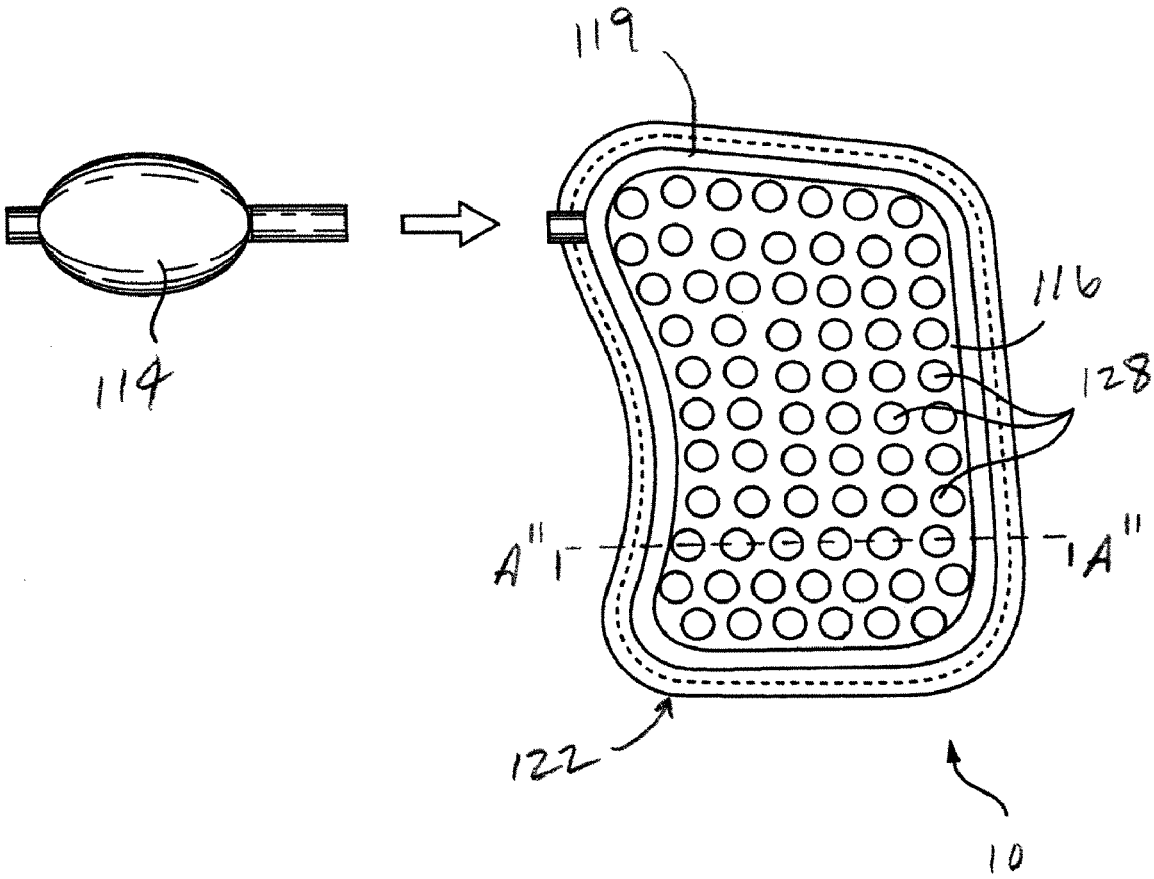
FIG. 10 is a back perspective view of an embodiment of the present invention.
Figure 11:
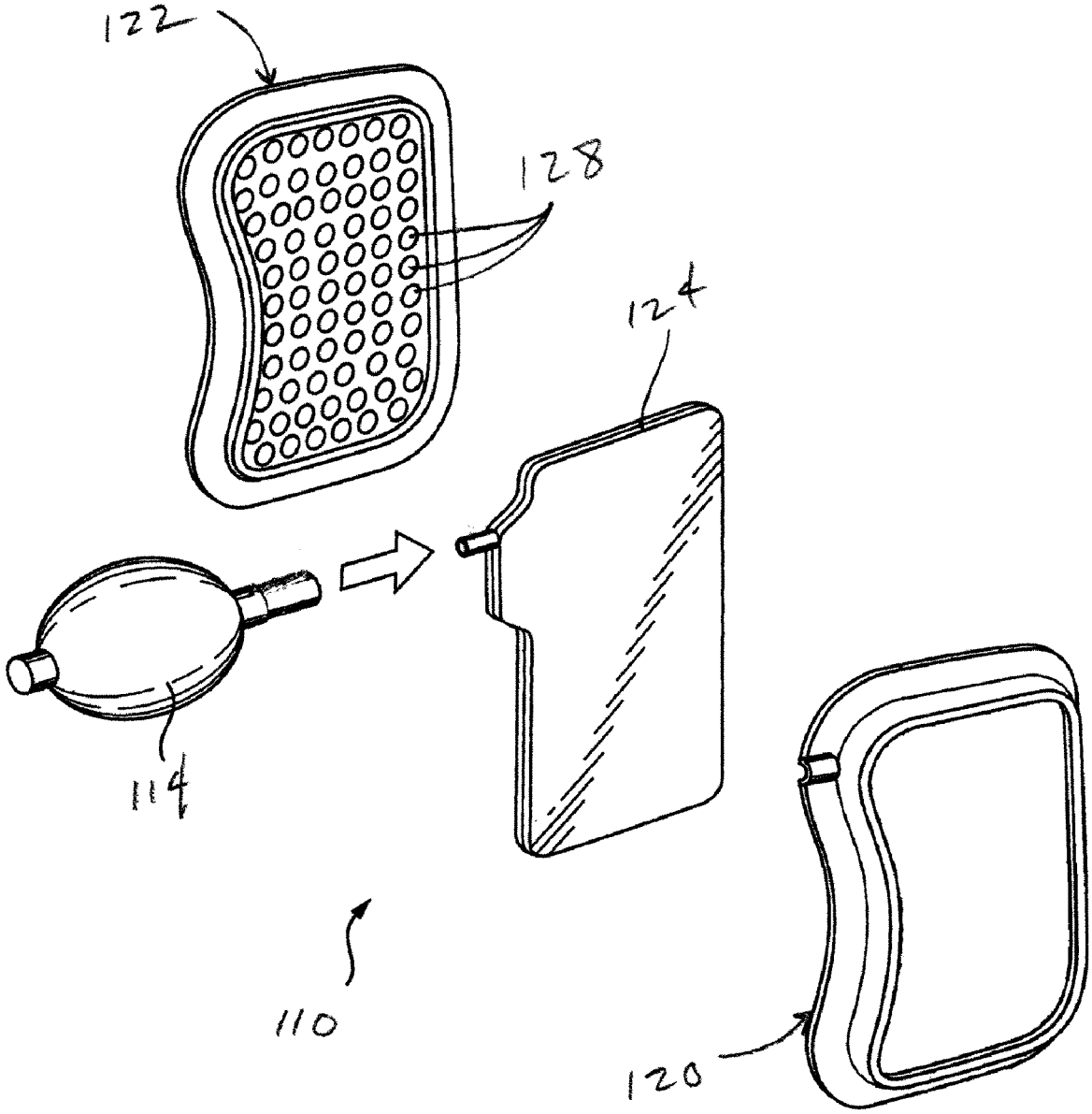
FIG. 11 is an exploded perspective view of the embodiment of FIG. 9.

Although use of the shock absorbing device of the present technology has been discussed with regard to use in the specific application of marksmanship, another aspect of the technology provides shock absorbing devices for use in other applications, such as contact sports, gravity game sports, and other impact sports. For example, there is shown in FIGS. 9-11 a shock absorbing device 110 according to the present technology having a pad 116 formed of two opposing layers 120 and 122. In a preferred embodiment, the outer layer 120 may be formed of a low density polyethylene material while the inner layer 122 may also be formed of a low density polyethylene material. The pad 116 may include one or more ribs 119 to stiffen the pad 116 at its periphery and define the shape of the pad. Furthermore, one or more of layers 120, 122 of the pad 116 may define dimples 128 protruding in a direction toward the opposing layer. The shock absorbing device 110 may further include a bladder 124 (shown in FIG. 11) disposed between the layers of pad 116. In addition, shock absorbing device 110 may include a pump 114 configured for removable attachment to the bladder 124.

Figure 12:
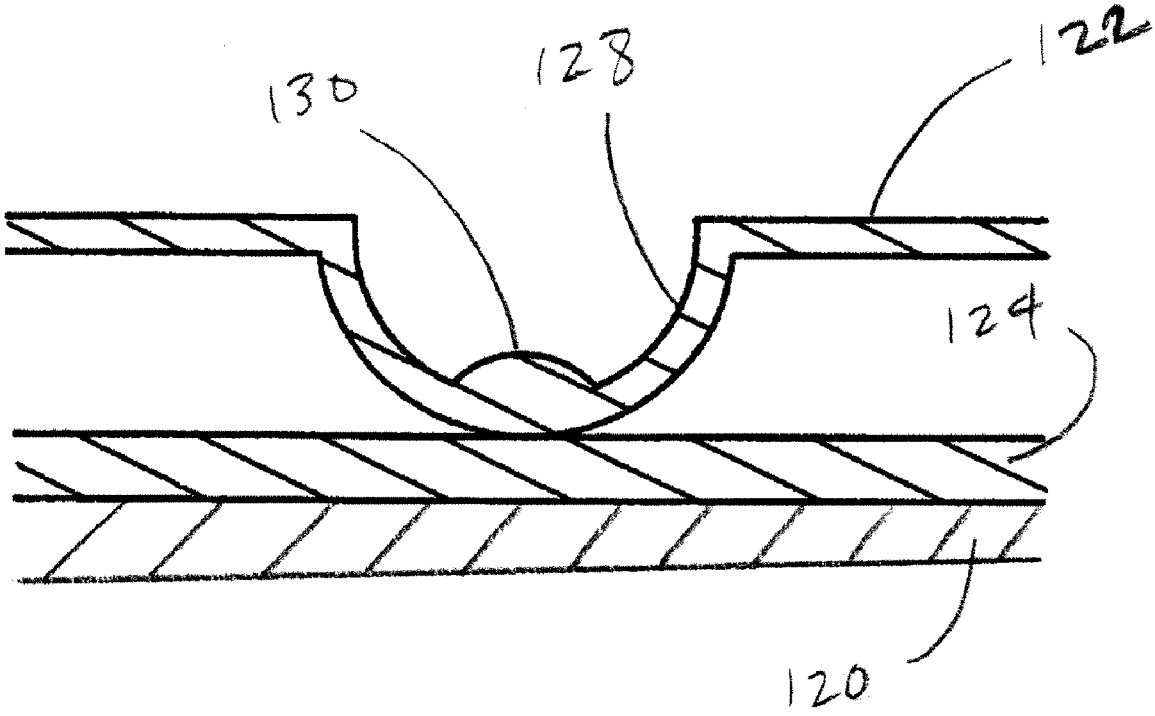
FIG. 12 is a cross-sectional view of the embodiment of FIGS. 9 and 11 taken along line A'-A' of FIG. 9.

The pad of the present embodiment is well suited for use as an athletic pad because of its thin profile. For example, in the embodiment shown in FIGS. 9 and 11, layer 122 of pad 116 defines dimples while layer 120 does not. Such an arrangement is further shown in the cross sectional view of FIG. 12. With this arrangement, the dimples 128 of layer 122 may still provide the necessary structure to aid in energy dissipation, behaving in the same way as described above, while at the same time the overall thickness of the device may be reduced. Such a reduction of thickness of the impact reduction device allows great flexibility and range of movement for an athlete using the device. Such a feature is beneficial to athletes competing, for example, in contact sports such as American football, soccer, and hockey, among others.

Figure 13:
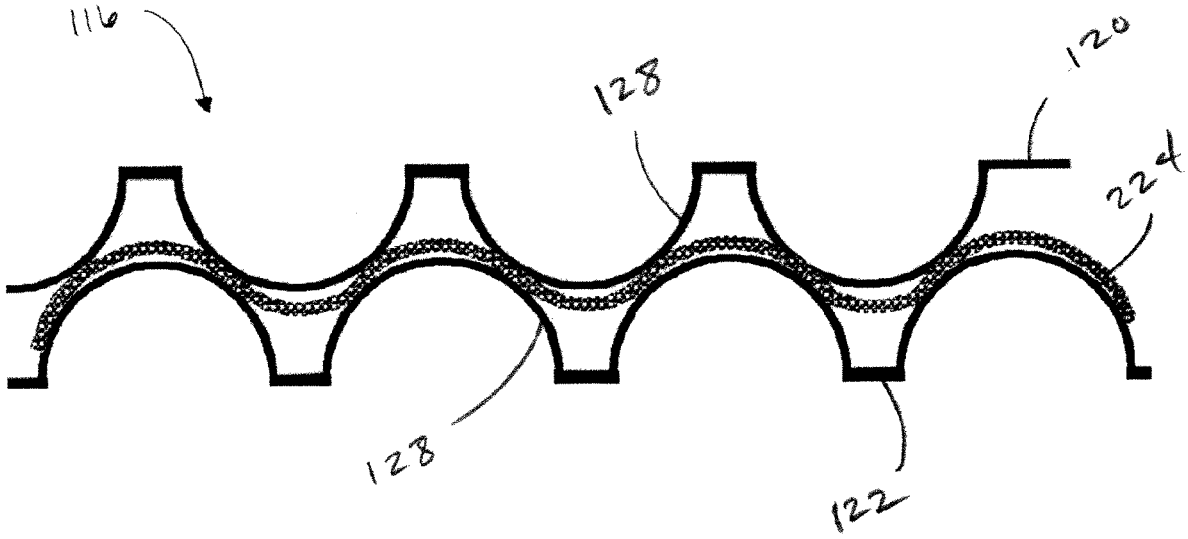
FIG. 13 is a cross-sectional view of an alternative embodiment of the present invention taken along line A"-A" of FIG. 10.

Similarly, as shown in FIG. 13, both layers 122 and 120 of pad 116 may define dimples that are offset from one another. In this arrangement the dimples 128 of layer 120 are aligned with the voids between the dimples of layer 122. Such an arrangement may provide an increased number of dimples as compared with the arrangement shown in FIGS. 9 and 11, while simultaneously maintaining a thin profile suitable for use in athletic equipment.

As shown in FIGS. 9-11, another distinguishing feature of the present embodiment is the pump configuration. In the case of athletic pads, the pump 114 may be directly attachable to the bladder 124 without the use of a conduit. Furthermore, the pump 114 may be detachable so that when the bladder 124 has been properly inflated the pump can be removed and will not interfere with the movement of the athlete thereafter. Upon removal of the pump 114, an interior valve (not shown) within the bladder 124 will close, thereby maintaining a desired volume of air within the bladder. Air may be released from the bladder by adjusting or squeezing the valve in such a way to open the valve to the flow of air.

Figure 14A:
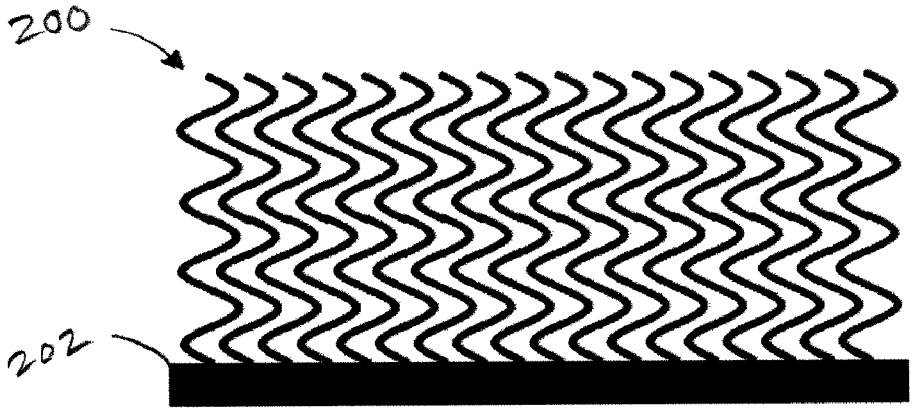
FIGS. 14*a*-14*d* are schematic diagrams of arrangements of the nanotubes of embodiments of the present invention.
Figure 14B:
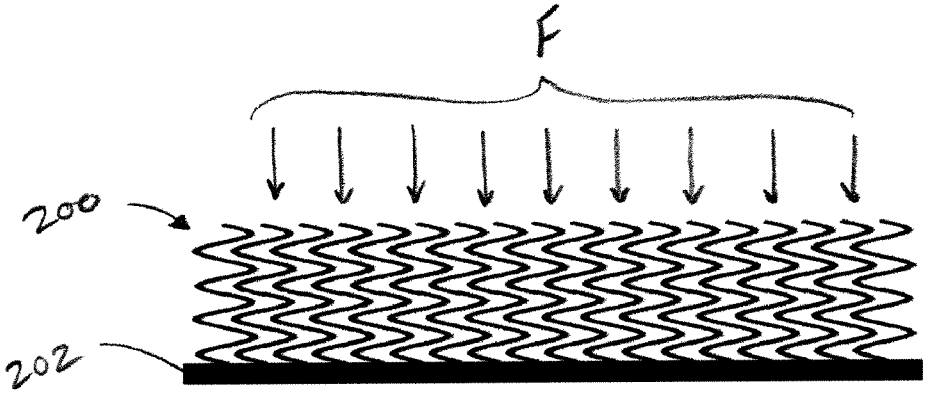
Figure 14C:
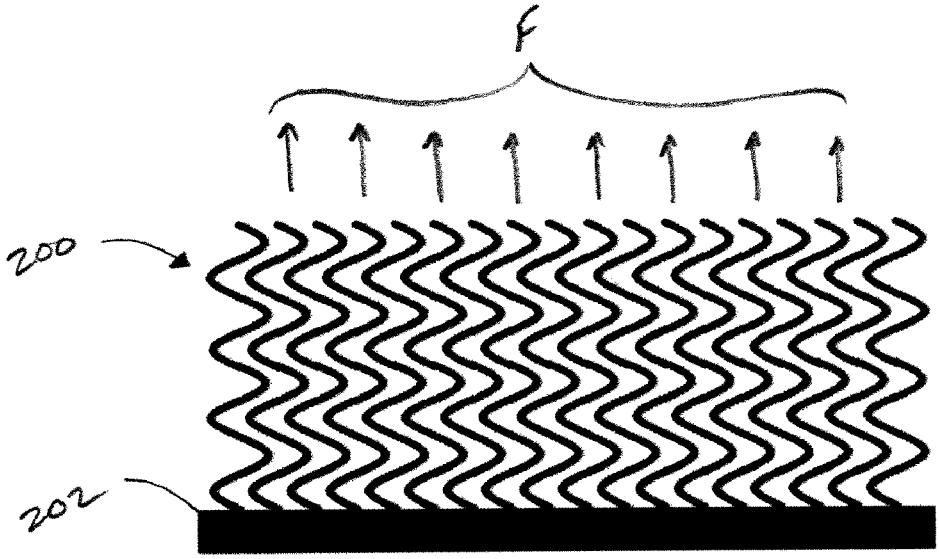
Figure 14D:
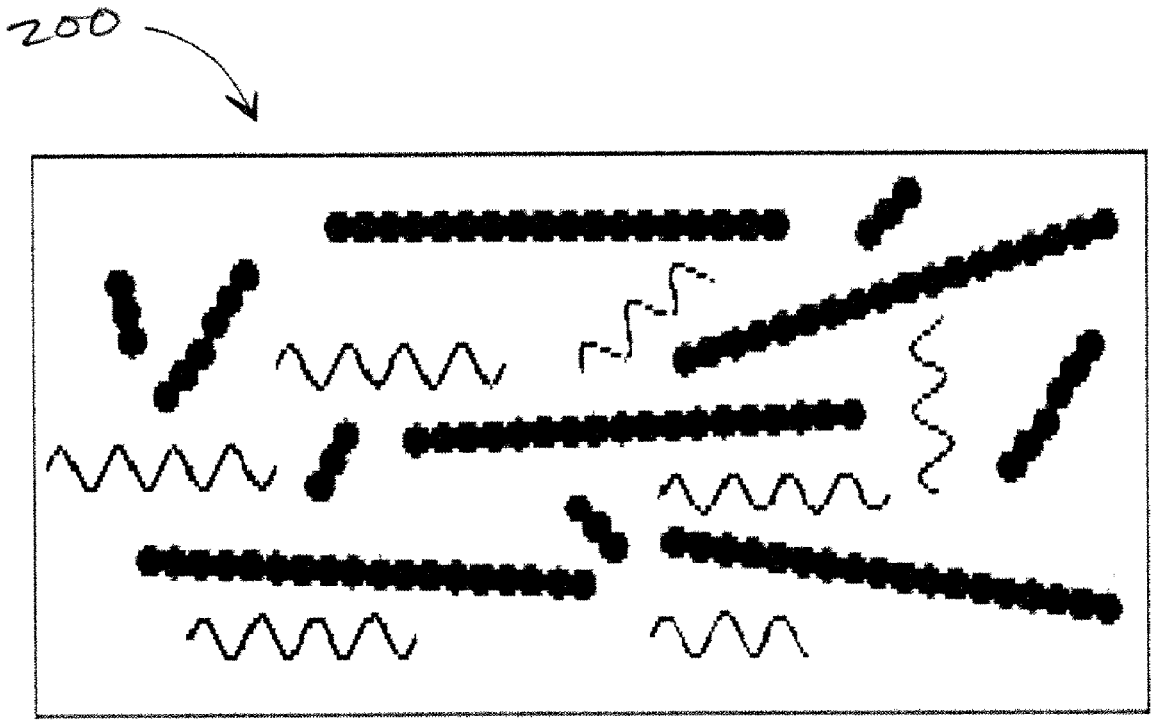

Referring to FIGS. 14*a*-14*d*, there is shown a forest of carbon nanotubes 200 as may be used in an embodiment of the present technology. The nanotubes may be coiled carbon nanotubes, shown in FIGS. 14*a*-14*c*, or composite carbon nanotubes, as shown in FIG. 14*d*, and may be attached to at least a portion of the impact reduction device to further enhance the shock absorbing capabilities of the device. Similar to the polyethylene described above, these nanotubes have the ability to lessen the impact to the human body by compressing upon application of a force F, as shown in FIG. 14*b*, and then resuming their pre-impact shape after the force is removed, as shown in FIG. 14*c*. A thin layer of the nanotube material may cover one or both sides of the polyethylene material 202 to enhance the impact absorption capabilities thereof. Alternatively, the nanotube material may replace the polyethylene material. Furthermore, the nanotube material may be layered over the bladder to prevent puncture.

Although the invention herein has been described with reference to particular embodiments, it is to be understood that these embodiments are merely illustrative of the principles and applications of the present invention. For example, the present invention may be used to protect workers in an industrial setting, at a construction site, etc. In order to accomplish this, the device of the present invention may, for example, be included in construction helmets, knee pads, or standing pads. It is therefore to be understood that numerous modifications may be made to the illustrative embodiments and that other arrangements may be devised without departing from the spirit and scope of the present invention as defined by the appended claims.

I claim:

1. An impact reduction device comprising:

a pad having a first layer, a second layer, and a third layer;

wherein the first layer comprises at least one resilient impression arranged and configured to at least partially collapse upon application of a force and return elastically to its original shape upon removal of the force, the second layer comprises at least one resilient impression arranged and configured to at least partially collapse upon application of a force and return elastically to its original shape upon removal of the force; and the third layer is interposed between the first and second layers, wherein the at least one resilient impression in each of the first and second layers is formed independently of the third layer.

2. The device of claim 1, wherein the third layer comprises nanometer-scale pure carbon cylindrical molecules selected from the group consisting of coiled carbon nanotubes and composite carbon nanotubes.

3. The device of claim 1, wherein the third layer comprises a sealable air bladder.

4. The device of claim 1, wherein the first layer comprises a low density polyethylene material.

5. The device of claim 1, wherein the shape of the pad is configured to conform to a predetermined portion of a user's body.

6. The device of claim 1, further comprising a puncture preventing layer.

7. The device of claim 3, wherein the bladder has a valve, the valve configured to facilitate inflation of the bladder by a detachable pump and configured to be disposed at the edge of the pad when the bladder is disposed between the first and second layers of the pad.

8. The device of claim 7, wherein the detachable pump is selected from the group consisting of hollow bulbs configured for manual compression, an aerosol pump, or a pneumatic pump.

9. The device of claim 1, wherein the first layer defines a plurality of impressions having void spaces therebetween, and the second layer defines a plurality of impressions arranged so that when the first and second layers are joined the impressions of the second layer align with the void spaces between the impressions of the first layer.

* * * * *